United States Patent [19]

Lee

[11] 4,058,865

[45] Nov. 22, 1977

[54] AUTOMATIC HIGH-SPEED COLD HEADING MACHINE

[76] Inventor: Yuan Ho Lee, 85, Jen Ho Road, Tainan, China /Taiwan

[21] Appl. No.: 759,371

[22] Filed: Jan. 14, 1977

Related U.S. Application Data

[63] Continuation-in-part of Ser. No. 733,898, Oct. 19, 1976, which is a continuation of Ser. No. 525,091, Nov. 19, 1974, abandoned.

[51] Int. Cl.[2] ..... B21K 1/46

[52] U.S. Cl. ..... 10/13

[58] Field of Search ..... 10/11 R, 11 E, 12 R, 10/12.5, 13, 15, 24

[56] References Cited

U.S. PATENT DOCUMENTS

| | | | |
|---|---|---|---|
| 2,664,579 | 1/1954 | Akey | 10/13 |
| 2,747,205 | 5/1956 | Fray | 10/13 |
| 2,768,394 | 10/1956 | Ward | 10/13 |

*Primary Examiner*—E. M. Combs

*Attorney, Agent, or Firm*—Lane, Aitken, Dunner & Ziems

[57] ABSTRACT

An automatic high-speed cold heading machine which forms heads on wire blanks by means of punch, cutting, and ejector mechanisms, where the operations of the punch and the ejector mechanisms are performed simultaneously and, wherein, the punch, the cutting knife and the ejector mechanisms are driven simultaneously in continuous harmonic motion with no pause or dwell for the purpose of achieving stable high speed operation.

11 Claims, 11 Drawing Figures

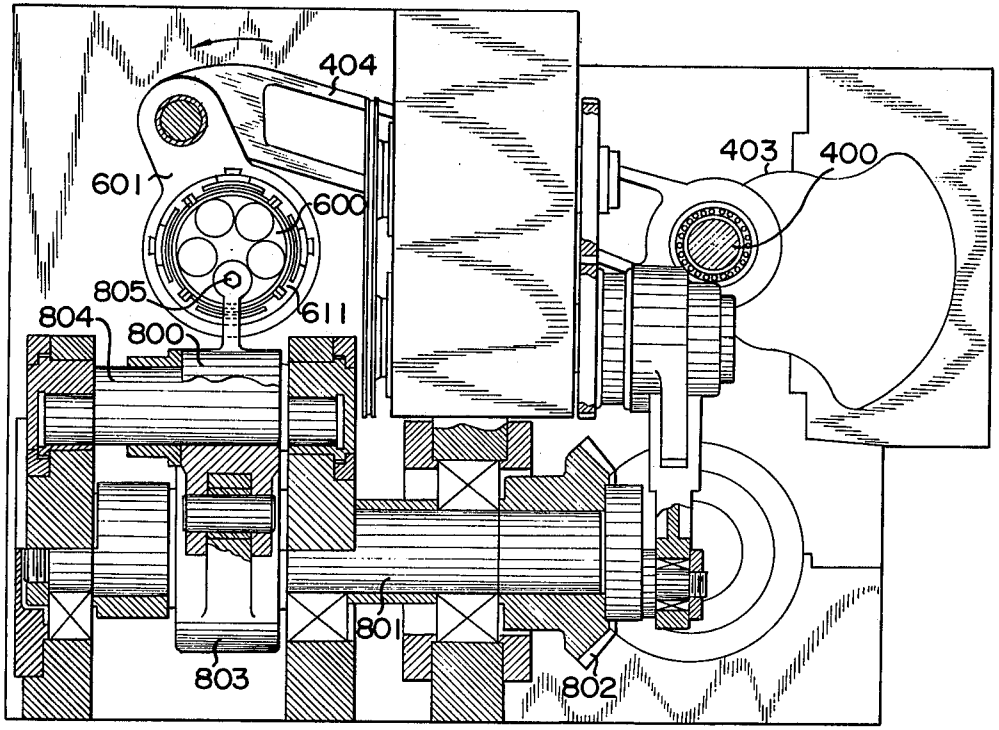
FIG. 2 B—B

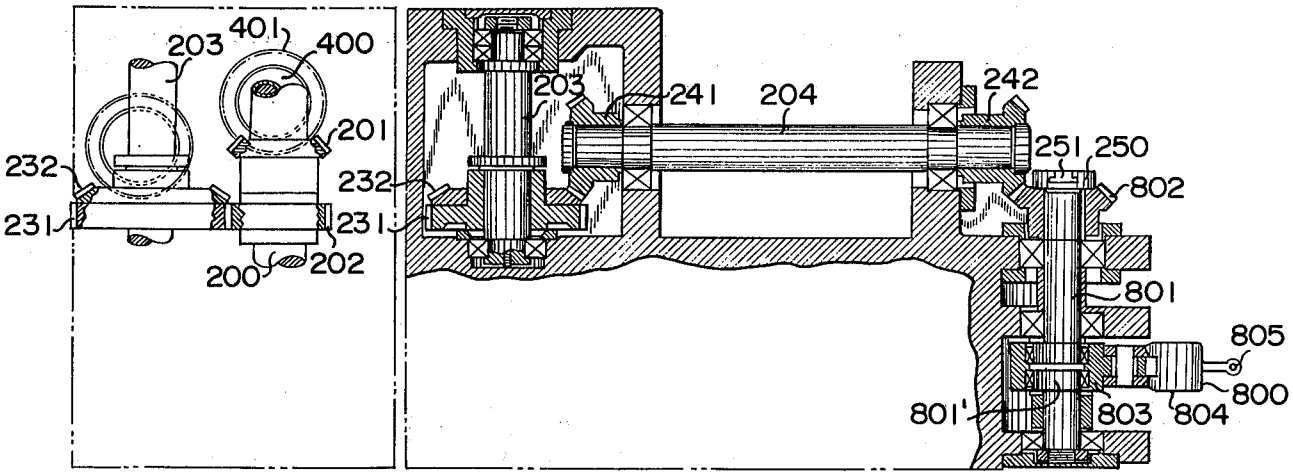
FIG. 3 c—c

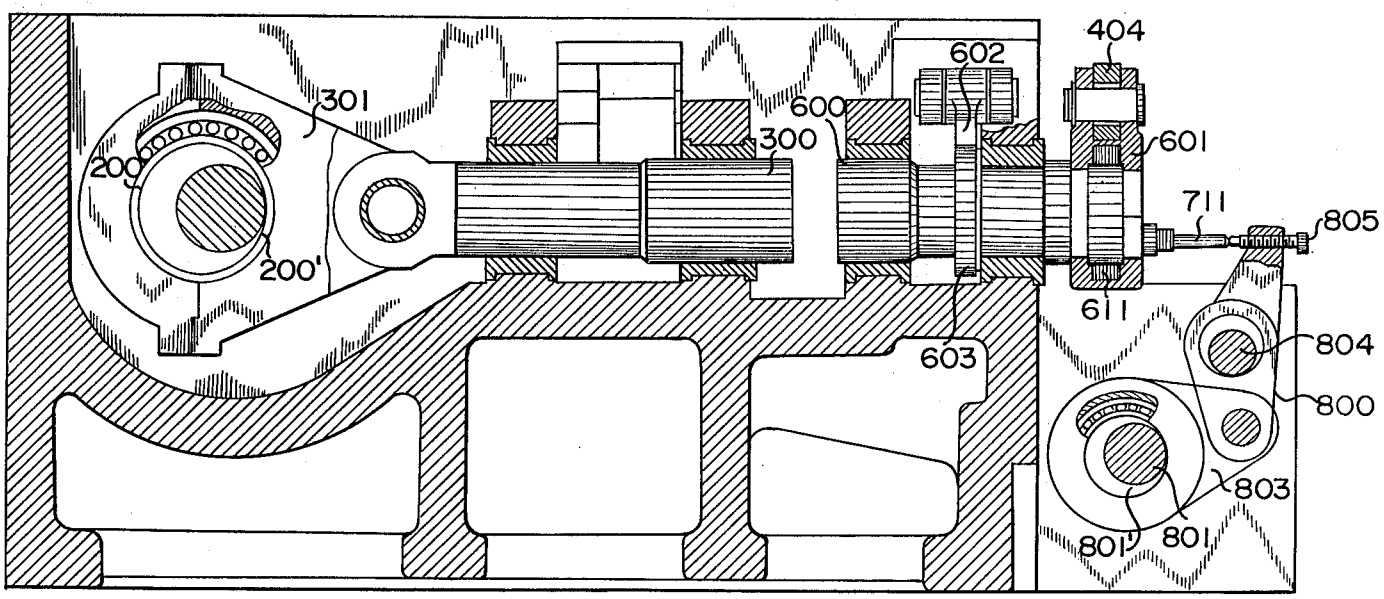
FIG. 4 D—D

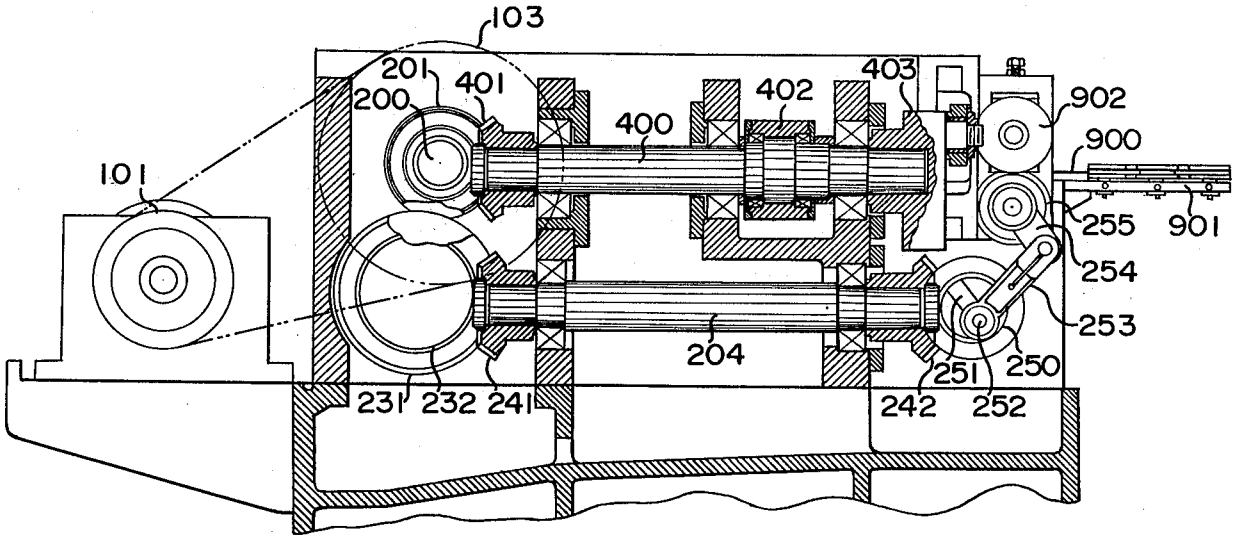
FIG. 5 E—E

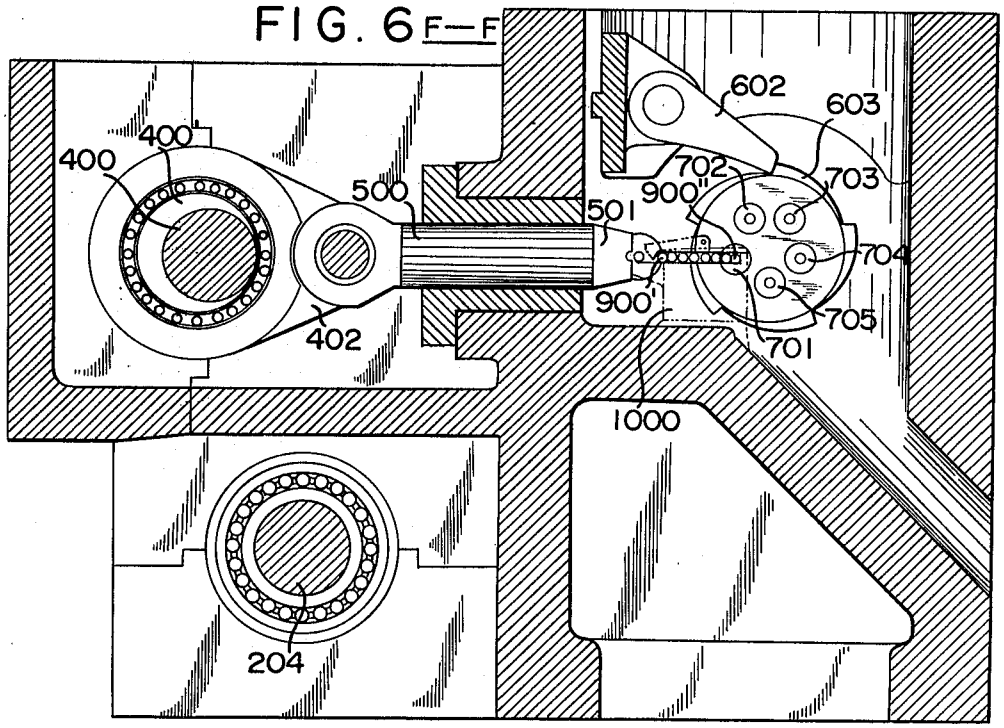
FIG. 6 F—F

AUTOMATIC HIGH-SPEED COLD HEADING MACHINE

CROSS-REFERENCE TO RELATED APPLICATIONS

This is a continuation-in-part of copending U.S. application Ser. No. 733,898, filed Oct. 19, 1976, which, in turn, is a continuation of Ser. No. 525,091, filed Nov. 19, 1974, now abandoned.

BACKGROUND OF THE INVENTION

In this art, conventional heading machines, whether of the double heading type or of the rotary type, generally all employ cams for one or more operations, at certain phases of the cycle, to cause the cam follower to cease movement, or to pause, at a certain angle in order to assure synchronization with other operations being performed by the machine. By this means, the cutting operation does not conflict with the process of punching, the punching operation does not conflict with the process of ejecting finished pieces from the die, and so on. Generally, these operations are staggered, with at least one operation being performed after another has been completed. For example, the punching step is executed after the cutting step is completed and the ejecting step is performed after the punching step is completed. For this reason, conventional heading machines must employ one or more cams that have a "pause" phase angle in one or more of the major machine operations, such as cutting, punching, and ejecting.

The major drawbacks of using such cam mechanisms to achieve high speed operation may be generally stated at least by the following three points. First, due to the fact that the cam follower of a cam device will pause and remain motionless for a specific phase angle of the cam surface, the work phase angle of the cam, which may drive the follower to perform a specific operation, will be decreased. As the length of the pause of the pause angle increases, the working phase angle will decrease proportionately. To compensate for this loss of working angle, the remaining working angle must be made steeper, thus causing the rate of acceleration of the follower to be increased. As the acceleration is increased the shock load and stress on both the cam and the follower is increased proportionately. For this reason, malfunctions, damage, and loss may be expected when one is trying to achieve high speed operation.

Second, in order to overcome the high speed stress mentioned above when the cam is driven at high speeds, it is necessary to increase the size of the cam and the cam follower so that their respective load carrying capacities will be increased. However, when the cam occupies more space, more inertia will be produced as the cam revolves. Therefore, cam mechanisms are not well suited to drive heading machine operations in high speed production.

Third, because the cam follower must use a spring in order to insure that the follower is always in contact with the cam surface during high speed operation or when the path of travel is too long, inertial forces on the follower will make it difficult for the follower to return smoothly to the cam surface. Thus, banging, vibration, and other undesirable phenomona, such as localized wear on the cam surface, will result.

BRIEF SUMMARY OF THE INVENTION

It will be apparent to those skilled in the art that if all operations can be performed at the same time, the rate of production will be increased significantly. In other words, for each individual operation that is performed by a conventional forming machine, a machine constructed according to the teachings illustrated in the present invention will have completed one piece. Furthermore, since each operation is independent of any other operation and since there is no conflict between operations, the machine can operate at speeds hitherto impossible. The present invention has attained production rates of 800 pieces per minute by employing a construction as further described in this specification.

By employing a feeding device as described in Patent No. 3,934,293 and a knockout mechanism as disclosed in Patent No. 3,938,208 (both patents of the applicant herein), and coordinating the operation of these devices to the indexing motion of a rotary die head, it is possible to run all operations in a heading machine from crank shafts or otherwise eccentric shafts, thereby eliminating the previously described defects of cams or other dwell producing mechanisms. Since the load carrying capacity of eccentric shafts far exceeds that of cams and since eccentric shafts have superior stability when compared to cams, there is a minimum wear on the machine parts and an absolute minimum of noice and vibration. Due to the fact that a shaft, whether used for punching, cutting or ejecting, can be driven in a constant harmonious motion without the pause or dwell produced by cams, a stable, safe, and efficient high speed production is possible with a minimum of malfunctions.

The purpose of the present invention is to eliminate the defects explained above and to provide an automatic cold heading machine whose operations for cutting wire blanks, punching the blanks, and ejecting finished pieces from the die are driven independently in a synchronized harmonious motion by means of eccentric shafts.

A more particular purpose of this invention is to provide a construction whereby all of the operations are driven simultaneously, so that a safe, stable and high speed operation can be obtained.

A further purpose of the present invention is to provide a machine in which no cam or other dwell producing device is employed in any of the cutting, feeding, punching or ejecting operations.

The objects and features mentioned hereinbefore of the present invention will become more apparent from the following description taken in conjunction with the accompanying drawings.

In the drawings:

FIG. 2 depicts a partial cross-sectional view to be viewed in the direction of the arrows at the ends of cutting plane line B—B in FIG. 1;

FIG. 3 depicts a cross-sectional view, to be viewed in the direction of the arrow heads at the ends of cutting plane line C—C in FIG. 1;

FIG. 4 depicts a cross-sectional view, to be viewed in the direction of the arrow heads at the ends of cutting plane line D—D in FIG. 1;

FIG. 5 depicts a cross-sectional view, to be viewed in the direction of the arrow heads at the ends of cutting plane line E—E of FIG. 1;

FIG. 6 depicts a cross-sectional view, to be viewed in the direction of the arrow heads at the ends of cutting plane line F—F in FIG. 1;

Figure 7A:
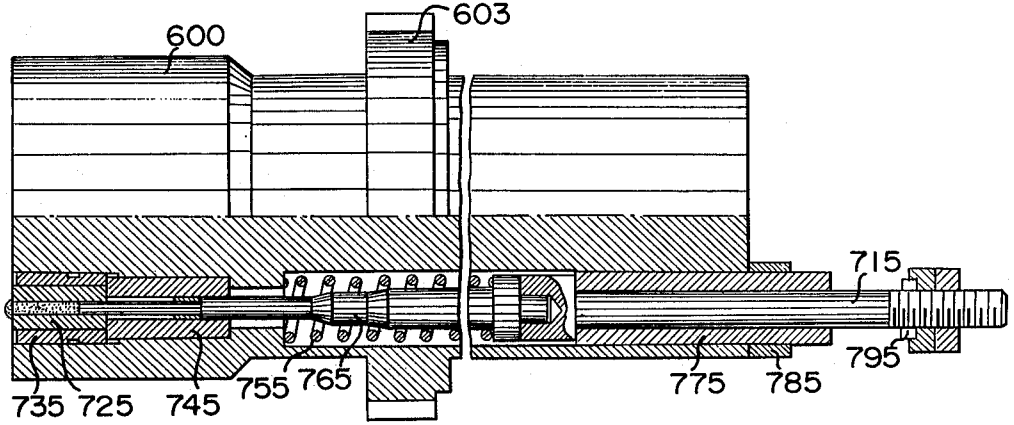
Figure 7B:
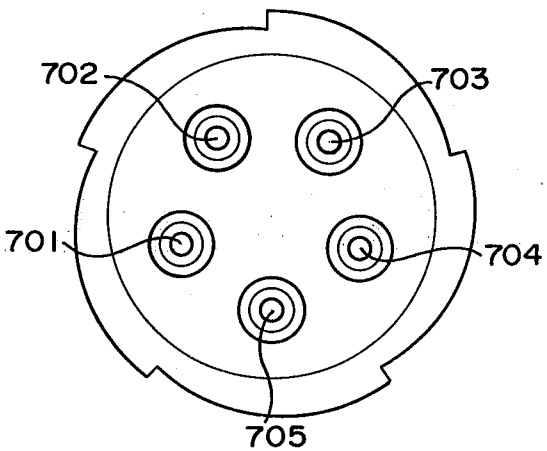
Figure 7C:
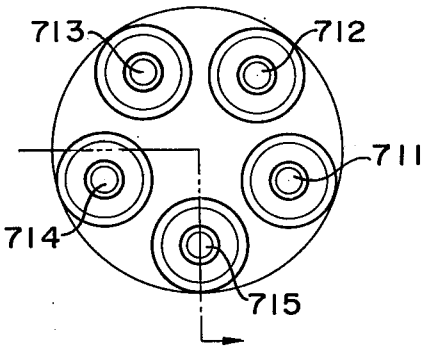
Figure 8A:
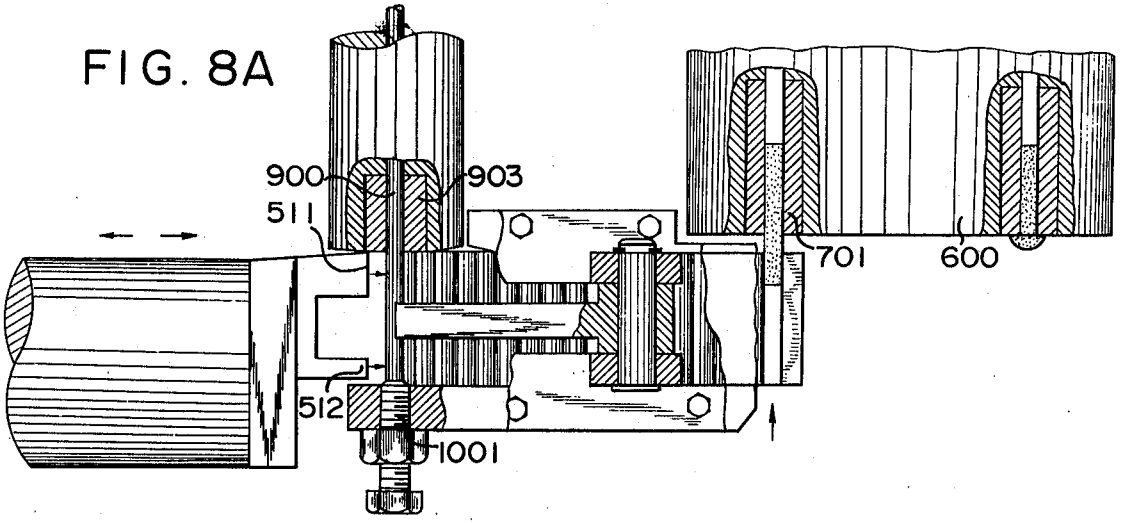
Figure 8B:
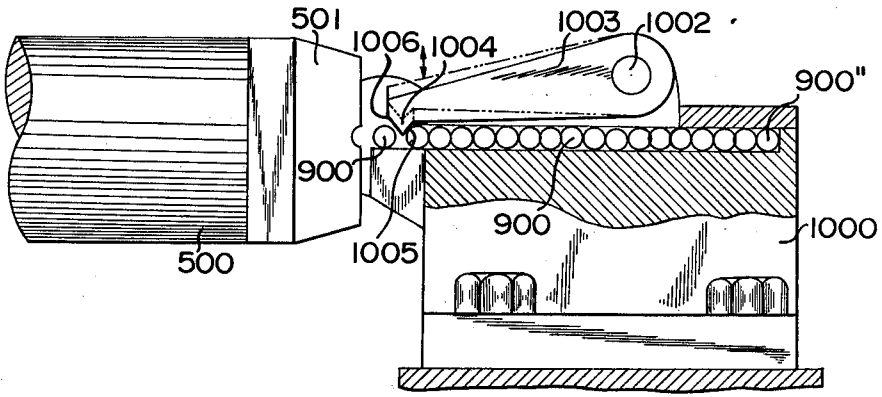

FIGS. 7A, 7B, and 7C depict partial cross-sectional views of the rotary die head and the arrangement of the dies and their related knockout rods; and FIGS. 8A and 8B respectively depict an enlarged detailed plane view and side view, partially in cross-section, of the blank cutoff and feeding device.

DETAILED DESCRIPTION OF THE PREFERRED EMBODIMENT

Figure 1:
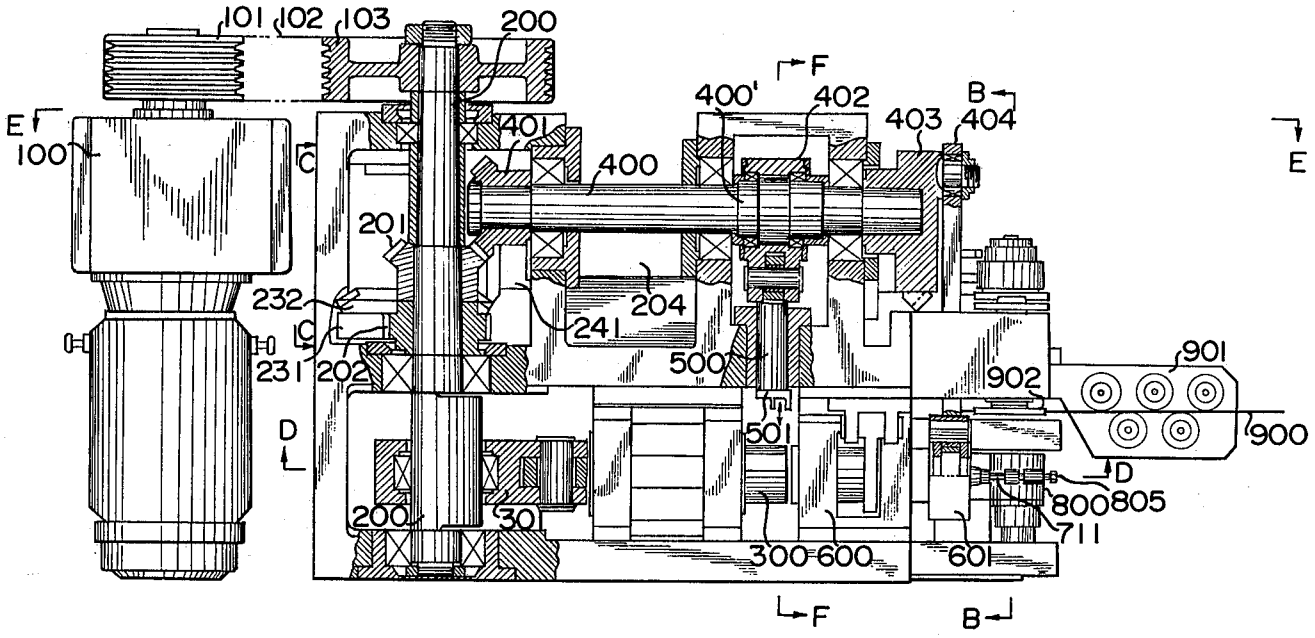
FIG. 1 depicts a plane view, partially in cross section, of a high speed machine according to the invention.

As shown in FIG. 1, a source of power which includes a motor 100 provides mechanical power to a main eccentric shaft 200 by means of a V-belt pulley 101 on the motor, a V-belt pulley 103 on the shaft, and a connecting V-belt 102. A bevel gear 201 and a spur gear 202 are keyed on the main shaft 200 and (as best seen in FIG. 4) a ram connection 301 is pivotally fixed to the ram 300 on an eccentric portion of the main shaft 200.

The bevel gear 201 is engaged with a bevel gear 401 which drives a wire-cutting eccentric shaft 400, on the other end of which is mounted a connection 402. The connection 402 is attached to one end of a reciprocating slide shaft 500, as best seen in FIG. 6. The shaft 500 has a cutting tool 501 affixed to its other end. The wirecutting eccentric shaft 400 also has an eccentric rotating disk 403 mounted on its extended end. One end of a driving link 404 connected to the disk 403 has a pivotal connection on a crank rod 601. The crank rod 601 is connected to a friction plate 611 (as best seen in FIGS. 2 and 4) and a cylindrical indexing table type die head 600, for the purposes of transmitting accurate intermittent motion to the die head 600. These connections are best seen in FIG. 2.

As shown in FIGS. 1 and 3, the spur gear 202 on the main eccentric shaft 200 is engaged with a spur gear 231 which is fixed on a rotating short shaft 203. The short shaft 203 is located behind the shaft 200 as shown in FIG. 1 as confirmed by the left hand portion of FIG. 3. The spur gear 231 on the short shaft 203 and a bevel gear 232 are coupled and rotate as a unit. A bevel gear 241 is attached to one end of a coupling shaft 204 and is engaged with a bevel gear 232. A bevel gear 242 on the other end of the shaft 204 is engaged with a bevel gear 802. The bevel gear 802 in turn drives an eccentric knockout shaft 801. A knockout connection 803 is mounted by means of antifriction bearings to the eccentric knockout shaft 804' on an eccentric portion of the shaft 804 (see FIG. 4). The knockout connection 803 is linked to a rocker arm 800 which is slipped over an eccentric shaft 804 so that the shaft 804 serves as a fulcrum for the oscillating motion of the rocker arm 800 and a ram bolt 805 (see FIG. 4). This simple construction results in an extremely high-speed and accurate knockout operation.

FIGS. 3 and 5 illustrate the manner in which a rotating disc 250 with a T-slot 251 sunk into the middle of its upper surface is fixed on the extreme end of the eccentric knockout shaft 801 on the same side of the shaft upon which the bevel gear 802 is keyed. A feeding roller 255 is caused to move by a connecting rod 253, which is pivotally connected at its upper end to a crank 254, while its lower end is connected to an adjustable sliding pin 252. When the disc 250 starts to move, the feed roller 255 will drive the other corresponding feed roller 902 to convey the wire stock 900 which is fed in from the wire straightener 901. Should it be necessary to vary the rate of feeding wire stock, the connection rod 253 may be set closer to or further away from the center of the T-slot 251 (see FIG. 5).

FIGS. 7A–7C illustrate the rotary die head with part of its interior structure shown in cross section. Numerals are provided for each individual part to clarify the presentation. In FIG. 7A, the rotating die head 600, which is made of a solid cylindrical body, is provided with several die impressions 701, 702, 703, 704, and 705 (see FIG. 7B) which are arranged at the end surface of the die head 600. A plurality of knockout rods 711, 712, 713, 714, and 715 extend through the rear of the die head 600.

In order to provide a detailed explanation of the die head of the present invention, the die impression 705 shown in cross section in FIG. 7A will be taken as an example. However, all of the dies are substantially identical in structure to the die 705.

The die impression 705 is provided with a front knockout rod 765. A sleeve 745 for the front knockout rod 765 is inlaid into a tapered hold provided in the end of the die head 600 that is nearest the die face. A die impression 725 made of tungsten tool steel is also inserted into the opening. Finally, each part is firmly fastened in the die head 600 by means of a tapered sleeve 735 which is inserted from the front of the die head 600. Furthermore, a coil spring 755 is coiled about the front knockout rod 765. The front knockout rod 765 is inserted from the rear end of the die. The unexposed end of the rear knockout rod 715 is directly connected to the rear end of the front knockout rod 765. The threaded sleeve 775 is used to adjust the amount of movement of the rear knockout rod 715. A lock nut 785 is used to hold the sleeve 775 tightly to the die head. A cushioning set 795 made of elastic material is mounted at the exposed end of the knockout rod 715 in order to absorb any shock load occurring during operation.

FIGS. 8A and 8B depict a partial cross-sectional view of the wire stock cutoff and feeding device. The wire stock 900 is fed in through the straightener 902 (see FIG. 1) and is passed through a cutting die 903 where it contacts an adjustable stopper 1001 that is used to adjust the length of the cutoff blank 900'. The stopper is located at the rear side of the cutoff blank stacker which is the side closest to the entry of the wire 900. As the wire cutting shaft 500 moves forward and cuts off wire stock into predetermined lengths by means of a U-shaped cutting tool with a semi-circular cutting edge 501, its two protruding arms, 511 and 512, accurately push the two ends of the cutoff blank 900' forward with uniform force into the cutoff blank stacker 1000. When the cutoff blank has been pushed into the cutoff blank stacker 1000, a retaining arm 1003, with inclined edges 1005 and 1006 at its pointed end, and able to move up and down by means of its fulcrum 1002, tightly holds and retains the cutoff blanks 901' so that they are closely stacked in a linear arrangement, with the foremost cutoff blank positioned at 900'' in the stacker 1000 in proper alignment with a die opening, such as 701, of the rotary die head 600. A rod (not shown) provided on the ram 300 then pushes the cutoff blank into the die opening. The cutting shaft need only travel a distance slightly larger than the diameter of the wire stock in order to accomplish both cutting and feeding to the stacker. Due to the efficiency of the stacker, the cutter may cut and feed in continuous harmonic motion with no pause or dwell.

As shown in FIGS. 2 and 6, the rotary die head 600 is driven by means of a frictional clutch 611 which is mounted on the cylindrical die head 600 and is connected to the shaft 400 by means of a drive link 404. The drive link 404 is connected at one end to a friction link 601 that drives the die head 600 in a rotary motion due to the oscillating motion of the friction link 601. The drive link 404 is connected at its other end to the eccentric shaft 400 and an eccentric plate 402. The frictional clutch 611 is so designed that the rotary die head 600 will be free to move with the frictional link 601 when the drive link 404 moves in the direction indicated by the arrow. As the drive link 404 makes a return movement, however, the frictional clutch 611 will prevent the die head 600 from moving in a reverse motion, and the die head will remain stationary until the drive link 404 again begins to move in the direction of the arrow. To insure that the rotary die head 600 is absolutely motionless during this reverse motion sequence of the drive link, the die head is provided with a ratchet 603 and a pawl 602 (see FIG. 6).

Now that the entire construction of the preferred embodiment of the present invention has been described in detail, it will be explained why such a construction provides for a bolt heading machine capable of a stable, safe, high speed heading operation that is superior to any that is known in the prior art.

Referring to FIG. 4, it will be noted that the ram 300 is depicted completely withdrawn from the face of the die head 600. However, due to the continuous rotation of the shaft 200, the eccentric portion 200' will immediately begin to drive the ram 300 forward toward the die face of the die head 600. It is at this precise moment that the eccentric portion 801' of the shaft 801 will begin to drive the knockout mechanism, and the ram bolt 805 will consequently begin to purch one of the knockout rods 711–15. At the same time, the cutting rod 500 will be returning to its original position in preparation for advancing and cutting a blank. As can be seen in FIG. 6, the cutting shaft 500 is driven by the same type of eccentric shaft as used to drive the ram and the knockout device. Therefore, there will be no dwell period throughout the cutting operation. As the above shafts continue to rotate, the ram 300 causes a ram rod (not shown) to feed a blank 900" from the stacker 1000 into the die that is in alignment with the new blank as it leaves the stacker. The ram 300 also causes punches (not shown) to perform the heading operation on blanks that are in the next three dies in sequence at the same time as the ram bolt 805 causes a knockout rod to eject a finished piece from the last and, in this case, the bottommost die in sequence. A cavity or recess (not shown) may be provided on the punch head to accommodate the blank being ejected to allow it to travel without obstruction from the die to a suitable reception trough from which it may leave the machine.

As the above-described punching and ejecting operations are being performed, the rotary die head 600 is prevented from rotating by the frictional clutch 611 and the locking action of the pawl 602 and the rachet 603. Only as the main ram 300 and the ram bolt 805 simultaneously begin to recede, will the rotary head 600 be free to rotate. As the head rotates one pitch of the distance between two successive dies, the ram 300 and the ram bolt 805 will simultaneously recede to their furthest point and begin to make a return stroke in order to perform the same operations on the newly-positioned dies. During the entire operation, there is no dwell or temporary cessation of any of the respective driving mechanisms. Due to the efficiency of the stacker 1000, the cutting shaft is not impeded by rotation of the die head 600.

Because of (1) the absence of any dwell in the individual operations, (2) the shorter distance traveled by all tools because of the superior load-carrying capacity of eccentric shafts over cams, and (3) the fact that the respective operations may be performed in a continuous harmonic motion with no pause or dwell, it is possible to perform at least 800 operations in 1 minute. In other words, bolts, screws, and the like, can be produced at the rate of at least 800 per minute when using a machine constructed according to the present preferred embodiment.

This invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. An automatic high speed cold heading machine comprising the combination of:

a main shaft which includes an eccentric portion thereon;

punching means, including a ram operably connected to said main shaft so that said ram reciprocates upon rotation of said main shaft, for punching blanks in a die to form a finished product;

a second shaft which includes an eccentric portion, said second shaft being operably geared to said main shaft;

blank cutting means operably connected to said second shaft so that said blank cutting means reciprocates upon rotation of said second shaft for cutting blanks;

means for receiving cut blanks from said blank cutting means;

a rotary die head having a plurality of dies respectively positioned in alignment with said ram, said rotary die head being operably connected for rotation to said second shaft;

a third shaft operably geared at about one end thereof to said main shaft;

a fourth shaft operably geared to the other end of said third shaft, said fourth shaft including an eccentric portion thereof;

ejecting means, including a rocker arm pivotably connected to the eccentric portion of said fourth shaft and coacting with rod means on said rotary die head, for ejecting blanks from said die head; and means for rotating said main shaft so that the main shaft imparts a compressive force against the rotary die head while the second shaft simultaneously drives the blank cutting means to cut a blank and feed a blank to the cut blank receiving means at the same time that the fourth shaft simultaneously drives the rocker arm to engage with and apply a force against a rod of said rod means causing said rod to cause a blank disposed in a die to be ejected therefrom, said blank cutting means, said punching means and said ejecting means being driven simultaneously and independently by said second shaft, said main shaft and fourth shaft respectively in a synchronized harmonious motion without significant pause or dwell.

2. The machine of claim 1 wherein said ram is operably connected to the eccentric portion of said main shaft.

3. The machine of claim 1 wherein said second shaft rotates in a direction substantially perpendicular to the main shaft and is connected thereto by bevel gears.

4. The machine of claim 1 wherein said blank cutting means includes a shaft having a cutting blade affixed.

5. The machine of claim 1 wherein said rotary die head includes a portion behind each die provided with a hollow bore coaxial with and communicating with the opening of the die, a rod located in each said portion of said die head, said rod extending from the rear of said die head for contact with said rocker arm.

6. The machine of claim 1 wherein said third shaft rotates substantially parallel to said main shaft and connected at its said other end by a bevel gear to a bevel gear provided on one end of said fourth shaft.

7. The machine of claim 1 wherein said rocker arm includes a knockout connection for pivoting said rocker arm and an extension for contacting one of said rods.

8. The machine as set forth in claim 1 wherein said ram further includes a punch assembly and a ram rod on the end thereof not connected to said main shaft, said punch assembly including a plurality of punches for performing heading operations on said blanks in said dies in sequence when the ram reciprocates in a forward direction to contact said rotary die head.

9. The machine of claim 8 wherein said ram rod is located in alignment with the forwardmost blank in the cut blank receiving means and is structurally adapted to push said blank from said means into a properly aligned die upon being driven in a direction toward said die head.

10. The machine of claim 9 wherein said punch assembly includes a recess thereon in a corresponding relationship to one of said dies to allow a blank to be ejected therefrom as the punch assembly approaches and contacts said die head.

11. An automatic high speed cold heading machine comprised of a main shaft having an eccentric portion and a ram means connected to the eccentric portion so that rotation of the shaft will impart a reciprocating movement to the ram means; a second shaft connected by means of bevel gears to suitable gears provided on said main shaft and having an eccentric portion thereon which has connected thereto a blank cutting means which is driven in reciprocating motion in response to the rotation of the second shaft, said cutting means including a shaft having a suitable blade affixed thereon and a blank stacking means suitable to receive blanks as they are cut by said blank cutter; a cylindrical rotary die head in alignment with said ram, having driving means operatively connected with said second shaft and having a plurality of suitable dies disposed on the end thereof nearest the ram, the portion of the die head behind each die being provided with a hollow bore coaxially with and communicative with the opening of the die, each bore having provided therein a rod and each rod extending out of the back of the rotary die head; a third shaft connected at one end to the main shaft by means of a gear that meshes with a suitable gear provided on the main shaft, the other end of the third shaft being provided with a bevel gear that meshes with a bevel gear that is provided with on one end of a fourth shaft, the fourth shaft having disposed thereon an eccentric portion, a rocker arm pivoted on the last said eccentric portion by means of a knockout connection, the rocker arm having an extension suitable to contact one of the above rods; the above cited construction characterized in that when the main shaft is rotated by means of a suitable drive means, the second and third shafts will rotate perpendicularly to the main shaft and the fourth shaft will rotate parallel to the main shaft, the main shaft will drive the ram to impart compressive force against the cylindrical rotary die head, and the second shaft driven by its gear-meshed connection to the main shaft, simultaneously drives the blank cutter to cut and complete feeding of a blank into the blank stacker, the fourth shaft simultaneously drives the rocker arm, by means of the rocker arm pivotal connection on the eccentric portion provided on said fourth shaft, to cause the rocker arm extension means to engage with and apply force against one of the rods, causing that rod to travel a specified distance into the die head through the hollow bore and to thus eject a blank from a specific die, the cutting, punching and ejecting operations resulting from simultaneous and independent operation of said shafts in a synchronized harmonious manner without significant pause or dwell.

* * * * *